United States Patent [19]

Rose

[11] 4,074,925

[45] Feb. 21, 1978

[54] SAFETY SOCKET FOR LAMPS AND THE LIKE

[76] Inventor: Manning I. Rose, 2301 Glenheath, Dayton, Ohio 45440

[21] Appl. No.: 708,353

[22] Filed: July 26, 1976

[51] Int. Cl.[2] ..... H01R 13/44

[52] U.S. Cl. ..... 339/44 R

[58] Field of Search ..... 339/36–44; 200/51.09

[56] References Cited

U.S. PATENT DOCUMENTS

| | | | |
|---|---|---|---|
| 943,958 | 12/1909 | Wheeler | 220/242 |
| 1,362,206 | 12/1920 | Ward | 339/36 |
| 1,901,040 | 3/1933 | Peroni et al. | 200/51.09 |
| 2,179,797 | 11/1939 | Nemeth | 200/51.09 |
| 2,221,345 | 11/1940 | Davis | 200/51.09 |
| 2,268,061 | 12/1941 | Richards | 200/51.09 |
| 2,306,741 | 12/1942 | Miller | 200/51.09 |
| 2,439,385 | 4/1948 | Goldberg | 200/51.09 |
| 2,688,669 | 9/1954 | Quill | 200/51.09 |
| 2,924,679 | 2/1960 | Brown, Jr. | 200/51.17 |
| 3,020,366 | 2/1962 | Dolph | 200/51.16 |
| 3,068,442 | 12/1962 | Kubik et al. | 339/36 |
| 3,155,788 | 11/1964 | Drago | 200/51.09 |
| 3,189,212 | 6/1965 | Bellek | 220/24.3 |
| 3,579,171 | 5/1971 | Woodward | 339/34 |
| 3,783,435 | 1/1974 | Fisher | 339/92 M |
| 3,810,070 | 5/1974 | Ludwig | 339/36 |
| 3,812,446 | 5/1974 | Sinclair | 339/41 |
| 3,812,446 | 5/1974 | Sinclair | 339/41 |
| 3,936,122 | 2/1976 | Hagelberg | 339/41 |
| 3,936,122 | 2/1976 | Hagelberg | 339/41 |

FOREIGN PATENT DOCUMENTS

| | | | |
|---|---|---|---|
| 1,540,150 | 5/1970 | Germany | 339/44 R |
| 2,229,543 | 2/1973 | Germany | 339/44 R |

*Primary Examiner*—Roy Lake
*Assistant Examiner*—Neil Abrams
*Attorney, Agent, or Firm*—Dybvig & Dybvig

[57] ABSTRACT

An insulator plate mounted on a socket shell housing is spring biased to cover one of the socket contacts when no load device is in the socket. To insert a load device into the socket, it is first necessary to move the insulator plate away from covering relation to the aforementioned socket contact.

5 Claims, 5 Drawing Figures

SAFETY SOCKET FOR LAMPS AND THE LIKE

BACKGROUND OF THE INVENTION

This invention relates to safety sockets of the type adapted to receive lamps or other load devices having a cylindrical shell terminal and a center base terminal. The socket of this invention is termed a safety socket because the likelihood that one inserting his fingers or a conductive object into the socket will receive a shock is remote. The background of this invention is the same as the background of the invention described in my copending application Ser. No. 513,632, filed Oct. 10, 1974, for SAFETY SOCKET FOR LAMPS AND THE LIKE, now U.S. Pat. No. 3,971,611, which application is incorporated herein by reference.

SUMMARY OF THE INVENTION

The present invention provides a socket with a construction to significantly reduce the likelihood of accidental shock and injury to a person who inserts a finger or other object in the socket. In my aforementioned copending application Ser. No. 513,632, now U.S. Pat. No. 3,971,611 an insulator plate is spring biased between two parts of a base contact assembly when the load device is removed. In accordance with the instant invention, an insulator assembly is provided including an insulator member pivotally mounted on the socket and spring biased into a first position whereat it overlies and covers the socket base contact. An object inserted into the socket can thus engage the insulator member but cannot engage the base contact which it covers.

When the insulator member overlies the base contact, a reset member connected thereto and forming part of the insulator assembly projects outwardly of the socket, the reset member being manually engageable to pivot the insulator member out of covering relation to the base contact to a second position to permit insertion of a load device into the socket. When in the second position, the insulator member is ineffective to prevent electrical connection between an object inserted in the socket and the source. When a load device is in the socket, it holds the insulator member in its second position.

In general it is an object of this invention to provide an inexpensive safety socket so designed that one merely inserting a finger or another object into the opening of the socket will not receive a shock.

DESCRIPTION OF THE PREFERRED EMBODIMENT

Figure 4:
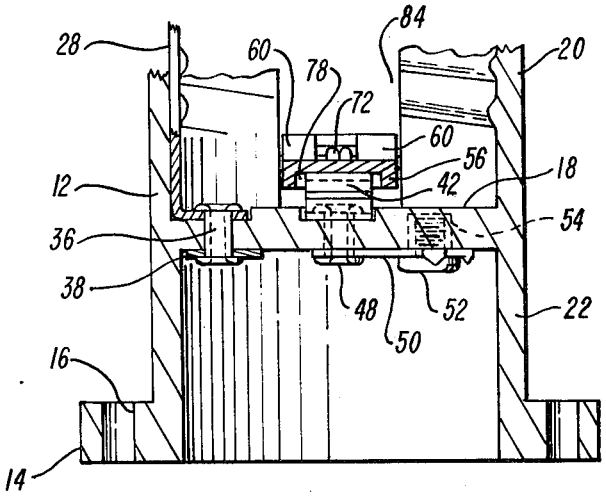
FIG. 4 is a sectional view taken along the line 4—4 of FIG. 3.
Figure 5:
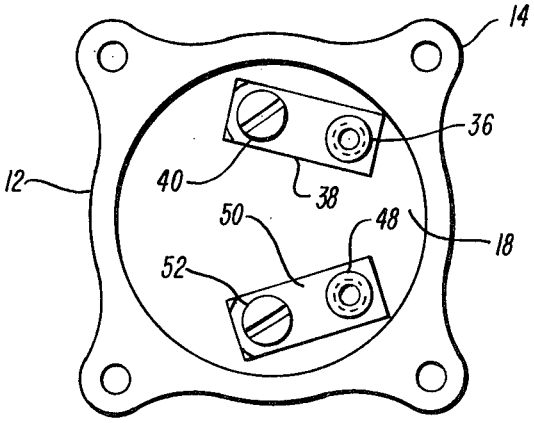
FIG. 5 is a bottom plan view of the socket as viewed from the position indicated by the arrows 5—5 of FIG. 3.

With reference to the drawing, this invention is illustrated as a modification of a socket 10 of the type comprising a one-piece hollow tubular housing 12 made from porcelain, plastic or other suitable insulating material, the lower end of which has outwardly projecting flanges 14 having holes 16 for receiving screws or other fastening means for mounting the socket 10 on a ceiling, wall, or other surface. A contact support plate 18 is connected to the wall of the housing 12 and preferably is integral therewith as shown in FIG. 4, the contact plate 18 dividing the housing 12 into an upper shell portion 20 opening at the top of housing 12 and a lower base portion 22 opening at the bottom of housing 12.

Figure 1:
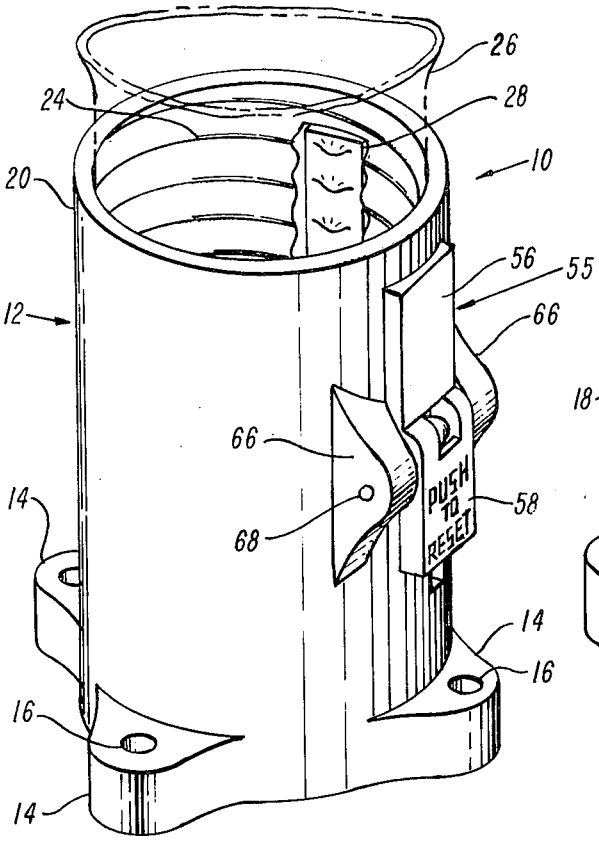
FIG. 1 is a perspective view of a safety socket made in accordance with this invention illustrating in phantom the base of a lamp in the socket.

The inside wall of the shell portion 20 is threaded, as indicated at 24, for receiving the cylindrical threaded shell terminal of a lamp, which is shown partially in phantom in FIG. 1 and designated 26, or various other load devices. For convenience, the shell 20 is described as adapted for receiving lamp bases, it being understood that it has more general utility.

Contact with a lamp base is provided by a shell contact member 28 having ridges 30 adapted to snugly engage the grooves and threads of the cylindrical shell terminal of the lamp 26. The shell contact 28 comprises an L-shaped strip of spring metal, the longer leg of which extends vertically within a groove 32 formed in the threaded portion 24 and the shorter leg of which lies in a groove 34. A rivet 36 extends through an aperture in the shorter leg of the shell contact 28 through an aligned aperture in the contact support plate 18 and another aligned aperture in a first pressure wire connector plate 38 located on the underside of the shell contact plate 18. The rivet 36 thus electrically connects the shell contact 28 to the connector plate 38 and mechanically connects the shell contact 28 and the plate 38 to the contact base plate 18. The connector plate 38 constitutes a socket terminal and is adapted to be connected to the source return line of a household electrical circuit by a suitable connector wire (not shown), one end of which will be connected to the connector plate 38 by being trapped between the plate 38 and the head of a terminal screw 40 threaded into an aperture in the connector plate 38.

A base contact member 42 comprising a strip of spring metal, the end of which is bent upwardly as indicated at 44 for engagement with the base terminal (not shown) of a load device, is confined within a groove 46 in the top surface of the contact support plate 18 and connected thereto by a rivet 48 that extends through aligned apertures in the base contact 42, the contact support plate 18 and a second pressure wire connector plate 50. The base contact 42 and the second connector plate 50 are thus electrically interconnected and mounted upon the contact support plate 18 by the rivet 48 in the same manner that the rivet 36 mounts and electrically connects the shell contact 28 and the first pressure wire connector plate 38. The second connector plate 50 also constitutes a socket terminal and is adapted to be connected to a source of household current through a suitable wire (not shown), one end of which will be trapped between the connector plate 50 and the head of a terminal screw 52 threaded into an aperture in the connector plate 50. As shown in FIG. 4, the screw 52 projects into a clearance hole 54 in the lower surface of the contact support plate 18. A similar clearance hole (not shown) is provided for receiving the terminal screw 40.

The parts of the socket as thus far described may be entirely conventional and the details of construction thereof form no part of this invention. Furthermore, this invention may be utilized with sockets of other conventional constructions that include a housing which forms means for receipt of a lamp base or the like and have shell and base contacts.

Figure 3:
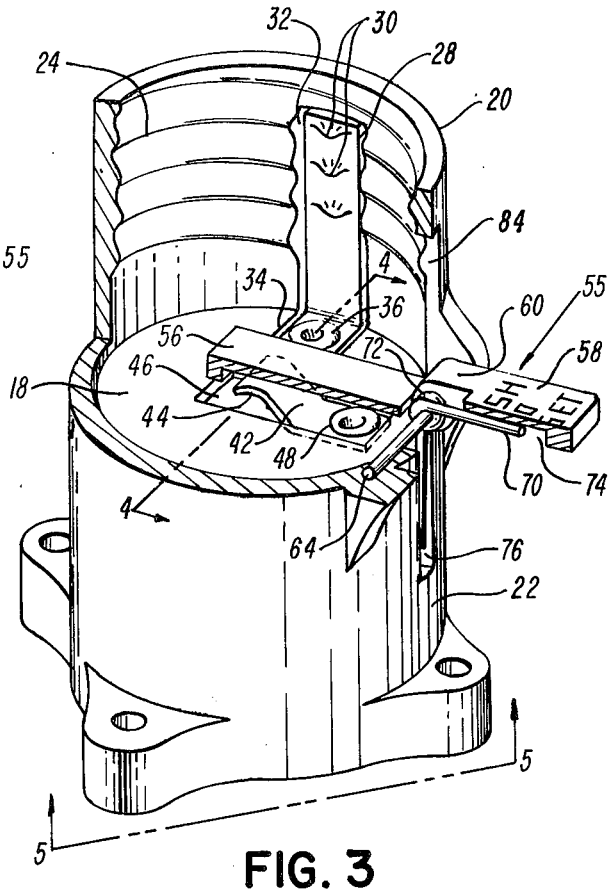
FIG. 3 is a perspective view similar to FIG. 1 but with portions removed and broken away to show the interior of the socket and showing the insulator member overlying the socket base contact.
Figure 2:
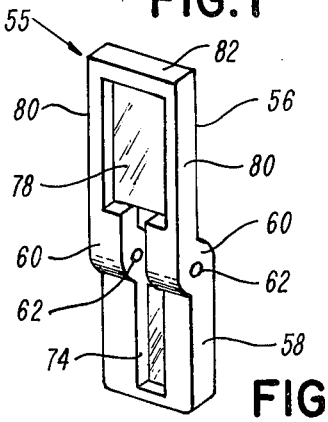
FIG. 2 is a perspective and enlarged view of an insulator assembly used in the safety socket of FIG. 1.

In accordance with this invention, an automatically operable insulating assembly 55 is provided for covering the base contact when the load device is removed from the socket. With reference to FIGS. 1, 2 and 3, the assembly 55 is preferably formed from a single piece of plastic or other insulating material and comprises a generally rectangular insulator member or plate 56 and a generally rectangular reset member or plate 58 which are interconnected by a pair of mutually spaced apart connecting members 60 having apertures 62 extending therethrough which are journalled on a pivot pin 64. The ends of the pivot pin 64 are mounted in bearing blocks 66 which are formed as ears or flanges projecting from the wall of the housing 12 and which have aligned apertures 68 therethrough for receipt of the pivot pin 64.

A spring wire 70 has an intermediate portion 72 coiled about the center of the pivot pin 64 between the connecting members 60. One end of the spring wire 70 is received within a notch 74 in one face of the reset plate 58 and the other end of the spring wire 70 is received within a vertically extending notch 76 located centrally between the bearing blocks 66 and beneath the pivot pin 64. As apparent, the spring wire 70 constitutes load responsive spring means which, when a load is removed from the socket, functions to bias the reset plate 58 to the generally horizontal position thereof shown in FIG. 3 wherein it projects outwardly from the housing 12. Because of the connection of the reset plate 58 to the insulator member 56, the member 56 is biased to the position shown in FIG. 3 inside the housing 12 in covering relation to the base contact 42. For this purpose, the face of the insulator member 56 confronting the base contact 42 has a recess 78 defined by sidewalls 80 and an end wall 82 of the insulating member 56 which straddle and partially enclose the base contact 42 when the insulator plate 56 is biased into covering relation thereto.

In FIG. 3 it will be observed that a portion of the housing generally located between the vertical planes in which the confronting walls of the bearing blocks are located and above the pivot pin 64 is cut away to form an opening 84 into which the insulator plate 56 may move. Also it will be observed that the members or plates 56 and 58 are generally parallel and nearly coplanar so that, by manually pushing downwardly on the reset plate 58 to the point whereat it engages the outside wall of the housing 12 as shown in FIG. 1, the insulator plate 56 will extend substantially vertically in covering relation to the opening 84. With the parts positioned as shown in FIG. 1, a lamp or other load device can be inserted into the opening of the shell portion 20 and threaded therein for engagement with the shell contact 28 and the base contact 42. When a load device is in the socket 10, the insulator plate 56 would be biased, because of engagement of the spring wire 70 with the reset plate 58, into engagement with the cylindrical terminal of the load device, but such cylindrical terminal will overcome the bias of the spring wire 70 so that the insulator assembly 55 will remain in the position thereof shown in FIG. 1.

Upon removal of a load device, the spring wire 70 coacting against the reset plate 58 will cause the insulator assembly 55 to pivot to the position thereof shown in FIGS. 3 and 4 wherein the base contact 42 is partially enclosed by the insulator plate 56. With the base contact 42 thus covered, one inserting a finger or conductive object into the socket could not accidentally engage the base contact 42 and receive a shock therefrom. In order to receive a shock it would be necessary not only to insert something into the socket but also to push downwardly on the reset plate 58 to overcome the bias of the spring wire 70.

For purposes of replacement of the load device, the reset plate 58 is pushed downwardly to position the insulator assembly 55 as shown in FIG. 1 so that a load device can be inserted into the socket.

As illustrated, a suitable legend may be printed or embossed on the reset plate 58 to indicate how it is to be used.

It will be appreciated that, with the use of this invention, it would be most unusual for one to accidentally receive a shock because the intentional act of holding down on the reset plate 58 while inserting something into the socket would be required to receive a shock from the base contact 42. Those familiar with the art will be aware that the pressure wire connectors should be connected to the household electrical circuit directly or by a polarized plug so that the source line will be connected to the base contact 42 and the source return line will be connected to the shell contact 28. With such connections, the danger of receiving an accidental shock is substantially removed.

Although the presently preferred embodiment of this invention has been described, it will be understood that within the purview of this invention various changes may be made within the scope of the appended claims.

Having thus described my invention, I claim:

1. In a safety socket of the type having a housing with wall means defining a load receiving portion having an opening at one end for passage of the base of a light bulb or the like load, a base contact at the bottom of said load receiving portion and confronting said opening for engaging one terminal of said load and a shell contact for engaging a second terminal of said load, and means for connecting one of said base and shell contacts to a source line and the other of said base and shell contacts to a source return line, the improvement wherein said socket further includes:

means defining in said wall means an aperture opening to said load receiving portion;

insulator means supported by said housing near said aperture for movement from a first position in which said insulator means extends through said aperture into said load receiving portion and overlies said one of said contacts to prevent an object extended into said load receiving portion through said opening from engaging said one of said contacts and thereby being electrically connected to said source, to a second position in which said insulator means is ineffective to prevent an object extended through said opening from engaging said one of said contacts;

a reset member at least partially external to said housing for receiving a force independent of the movement of said load applied externally of said housing for moving said insulator means from said first position to said second position; and load responsive means for moving said insulator means from said second position to said first position upon removal of said load from said load receiving portion.

2. The socket of claim 1 wherein said insulating means comprises a generally rectangular first plate, and said reset means comprises a second plate connected to said first plate for movement therewith.

3. The socket of claim 2 wherein said insulating plate and said reset plates are made in one piece, said piece being supported for pivotal movement on said housing to permit movement of said insulator plate from said first position to said second position.

4. The socket of claim 3 wherein said piece is mounted for pivotal movement on said housing by a pivot pin extending through said piece and supported on said housing and wherein said load responsive means comprises a spring coiled about said pivot pin having one end engaged with said housing and the other end engaged with said reset plate.

5. In a safety socket of the type having a housing with wall means defining a socket shell having an opening at one end for passage of the base of a light bulb or the like load, a base contact at the bottom of said shell and confronting said opening for engaging one terminal of said load and a shell contact for engaging a second terminal of said load, and means for connecting said base contact to a source line and said shell contact to a source return line, the improvement wherein said socket further includes:

means defining in said wall means an aperture opening to said socket shell;

insulator means supported by said housing near said aperture for movement from a first position in which said insulator means extends through said aperture into said socket shell and overlies said base contact to prevent an object extended into said socket shell through said opening from engaging said base contact and thereby being electrically connected to said source, to a second position in which said insulator means is ineffective to prevent an object extended through said opening from engaging said base contact;

a reset member at least partially external to said housing for receiving a force independent of the movement of said load applied externally of said housing for moving said insulator means from said first position to said second position; and load responsive means for moving said insulator means from said second position to said first position upon removal of said load from said socket shell.

* * * * *